US009523295B2

(12) United States Patent
Kawada et al.

(10) Patent No.: US 9,523,295 B2
(45) Date of Patent: Dec. 20, 2016

(54) CONTROLLER OF VARIABLE VALVE APPARATUS OF INTERNAL COMBUSTION ENGINE AND VARIABLE VALVE SYSTEM OF INTERNAL COMBUSTION ENGINE

(71) Applicant: HITACHI AUTOMOTIVE SYSTEMS, LTD., Hitachinaka-shi, Ibaraki (JP)

(72) Inventors: Shinichi Kawada, Isehara (JP); Naoki Kokubo, Hiratsuka (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 118 days.

(21) Appl. No.: 14/489,072

(22) Filed: Sep. 17, 2014

(65) Prior Publication Data

US 2015/0075475 A1 Mar. 19, 2015

(30) Foreign Application Priority Data

Sep. 19, 2013 (JP) ..... 2013-194160

(51) Int. Cl.
*F01L 9/04* (2006.01)
*F01L 13/00* (2006.01)
*F01M 1/06* (2006.01)

(52) U.S. Cl.
CPC ..... *F01L 13/00* (2013.01); *F01L 9/04* (2013.01); *F01L 2009/0484* (2013.01); *F01M 2001/064* (2013.01)

(58) Field of Classification Search
CPC ..... F01L 13/00; F01L 13/04; F01L 2013/103; F01L 2013/116; F01L 9/04; F01L 2009/0484; F01M 1/06; F01M 2001/064
USPC ..... 123/90.11, 90.12, 90.15, 179.18, 182.1
See application file for complete search history.

(56) References Cited

U.S. PATENT DOCUMENTS

| | | | | |
|---|---|---|---|---|
| 6,216,652 | B1 | 4/2001 | Gramann et al. | |
| 7,159,555 | B2 * | 1/2007 | Nohara | F01L 13/0005 123/179.18 |
| 7,802,546 | B2 * | 9/2010 | Nakamura | F01L 1/022 123/345 |
| 8,868,316 | B2 * | 10/2014 | Kokubo | F01L 1/352 701/103 |
| 2012/0174883 | A1 | 7/2012 | Kokubo et al. | |

FOREIGN PATENT DOCUMENTS

| | | | |
|---|---|---|---|
| JP | 2000-345818 | A | 12/2000 |
| JP | 2006-220013 | A | 8/2006 |
| JP | 2012-145036 | A | 8/2012 |
| JP | 2016-053325 | A | 4/2016 |

* cited by examiner

*Primary Examiner* — Hai Huynh
(74) *Attorney, Agent, or Firm* — Foley & Lardner LLP

(57) ABSTRACT

A controller of a variable valve apparatus of an internal combustion engine has an engine start indication detecting circuit that detects an indication of an engine start. When the indication of the engine start is detected by the engine start indication detecting circuit in a state in which temperature of the engine is lower than a predetermined temperature, an electric motor provided in the variable valve apparatus is supplied with a current, and this current supply to the electric motor is maintained for a predetermined time from a time point of the detection of the indication of the engine start to an engine cranking start.

21 Claims, 6 Drawing Sheets

CONTROLLER OF VARIABLE VALVE APPARATUS OF INTERNAL COMBUSTION ENGINE AND VARIABLE VALVE SYSTEM OF INTERNAL COMBUSTION ENGINE

BACKGROUND OF THE INVENTION

The present invention relates to a controller of a variable valve apparatus of an internal combustion engine, which variably controls opening and closing timing of an intake valve and/or an exhaust valve of the engine, and a variable valve system of the internal combustion engine.

In recent years, there have been proposed and developed various variable valve apparatuses that control the opening and closing timing of the intake valve and/or the exhaust valve by a driving force (a turning force) of an electric motor.

One such variable valve apparatus is disclosed in Japanese Patent Provisional Publication No. 2012-145036 (hereinafter is referred to as "JP2012-145036") that was filed by applicants of the present application. The variable valve apparatus is configured to change the opening and closing timing of e.g. the intake valve according to an engine operating state by transmitting the turning driving force of the electric motor to a camshaft through a speed reduction mechanism that has an eccentric cam, internal teeth and a plurality of rollers provided between the eccentric cam and the internal teeth.

To secure smooth action or movement of each component in the speed reduction mechanism of the electric motor-driven variable valve apparatus, lubricating oil that lubricates each sliding portion of the internal combustion engine is provided at an inside of the speed reduction mechanism.

SUMMARY OF THE INVENTION

In the speed reduction mechanism disclosed in the JP2012-145036, since there is a need to lubricate each roller and its contact portion and a gap between each roller and its contact portion at an engine re-start, the speed reduction mechanism is required to store some lubricating oil in the speed reduction mechanism at an engine stop.

However, because viscosity of the lubricating oil becomes high in a low temperature state during the engine stop, there is a possibility that, at the engine re-start, working or operating response of the speed reduction mechanism will deteriorate due to the high lubricating oil viscosity.

It is therefore an object of the present invention to provide an variable valve apparatus of the internal combustion engine which is capable of suppressing the deterioration in the operating response of the variable valve apparatus by energizing the electric motor just before the engine start and lowering the viscosity of the lubricating oil using this generated heat.

According to one aspect of the present invention, a controller of a variable valve apparatus of an internal combustion engine comprises: an engine start indication detecting circuit that detects an indication of an engine start. The variable valve apparatus has an output member that is operated according to a power transmitted from an electric motor through a speed reduction mechanism adjacent to the electric motor, and changes opening and closing timing of an engine valve according to the operation of the output member. The speed reduction mechanism is supplied with lubricating oil. When the indication of the engine start is detected by the engine start indication detecting circuit in a state in which temperature of the engine is lower than a predetermined temperature, the electric motor is supplied with a current, and the current supply to the electric motor is maintained for a predetermined time from a time point of the detection of the indication of the engine start to an engine cranking start.

According to another aspect of the present invention, a controller of an electric motor used for a variable valve apparatus of an internal combustion engine comprises: an engine start indication detecting circuit that detects an indication of an engine start. The variable valve apparatus has an output member that is operated according to a power transmitted from the electric motor through a speed reduction mechanism adjacent to the electric motor, and changes opening and closing timing of an engine valve according to the operation of the output member. The speed reduction mechanism is supplied with lubricating oil. When the indication of the engine start is detected by the engine start indication detecting circuit in a state in which temperature of the engine is lower than a predetermined temperature, the electric motor is supplied with a current, and the current supply to the electric motor is maintained at least for a predetermined time from a time point of the detection of the indication of the engine start to an engine cranking start with the operation of the output member restrained.

According to a further aspect of the invention, a variable valve system of an internal combustion engine, comprises: a variable valve apparatus having (a) an electric motor; (b) a speed reduction mechanism disposed adjacent to the electric motor and supplied with lubricating oil; and (c) an output member operated according to a power transmitted from the electric motor through the speed reduction mechanism, and changing opening and closing timing of an engine valve according to the operation of the output member; a temperature detecting unit which detects an engine temperature; an engine start indication detecting unit which detects an indication of an engine is start; and a controller for controlling the electric motor, which when a temperature detected by the temperature detecting unit is lower than a predetermined temperature, supplies a current to the electric motor and maintains the current supply to the electric motor for a predetermined time from a time point when the indication of the engine start is detected by the engine start indication detecting unit to a time point when a normal control is started so that in a state in which the output member is restrained to one side of an operation range of the output member, the output member is operated in a restraining direction.

The other objects and features of this invention will become understood from the following description with reference to the accompanying drawings.

DETAILED DESCRIPTION OF THE INVENTION

According to the present invention, by lowering the viscosity of the lubricating oil in the speed reduction mechanism just before the engine start, it is possible to suppress the deterioration in the operating response of the variable valve apparatus at the engine start.

Embodiments of a controller of a variable valve apparatus of the internal combustion engine and a variable valve system of the internal combustion engine will now be explained below with reference to the drawings.

First Embodiment

Figure 1:
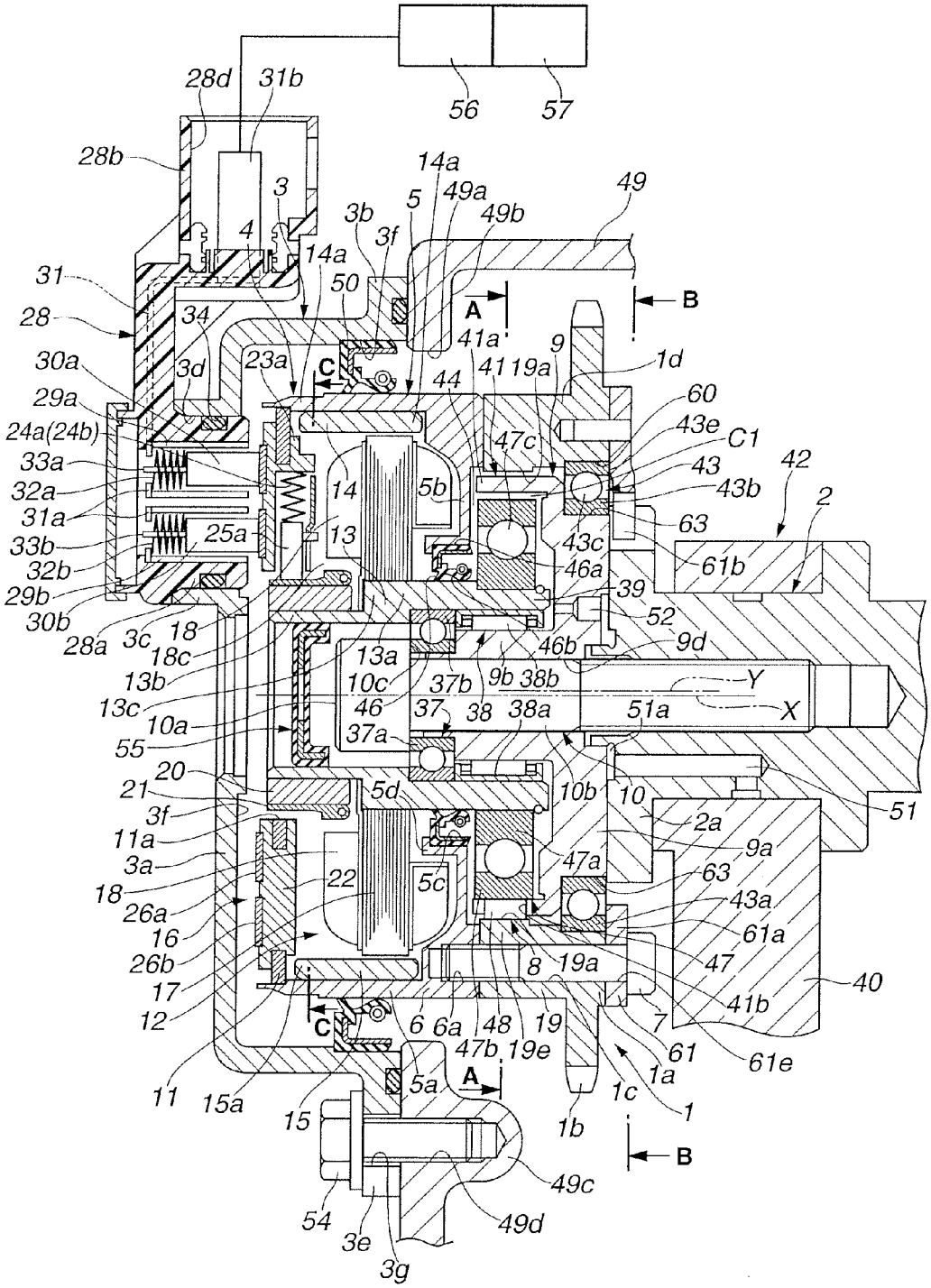
FIG. 1 is a longitudinal cross section of a variable valve apparatus according to one embodiment of the present invention.
Figure 2:
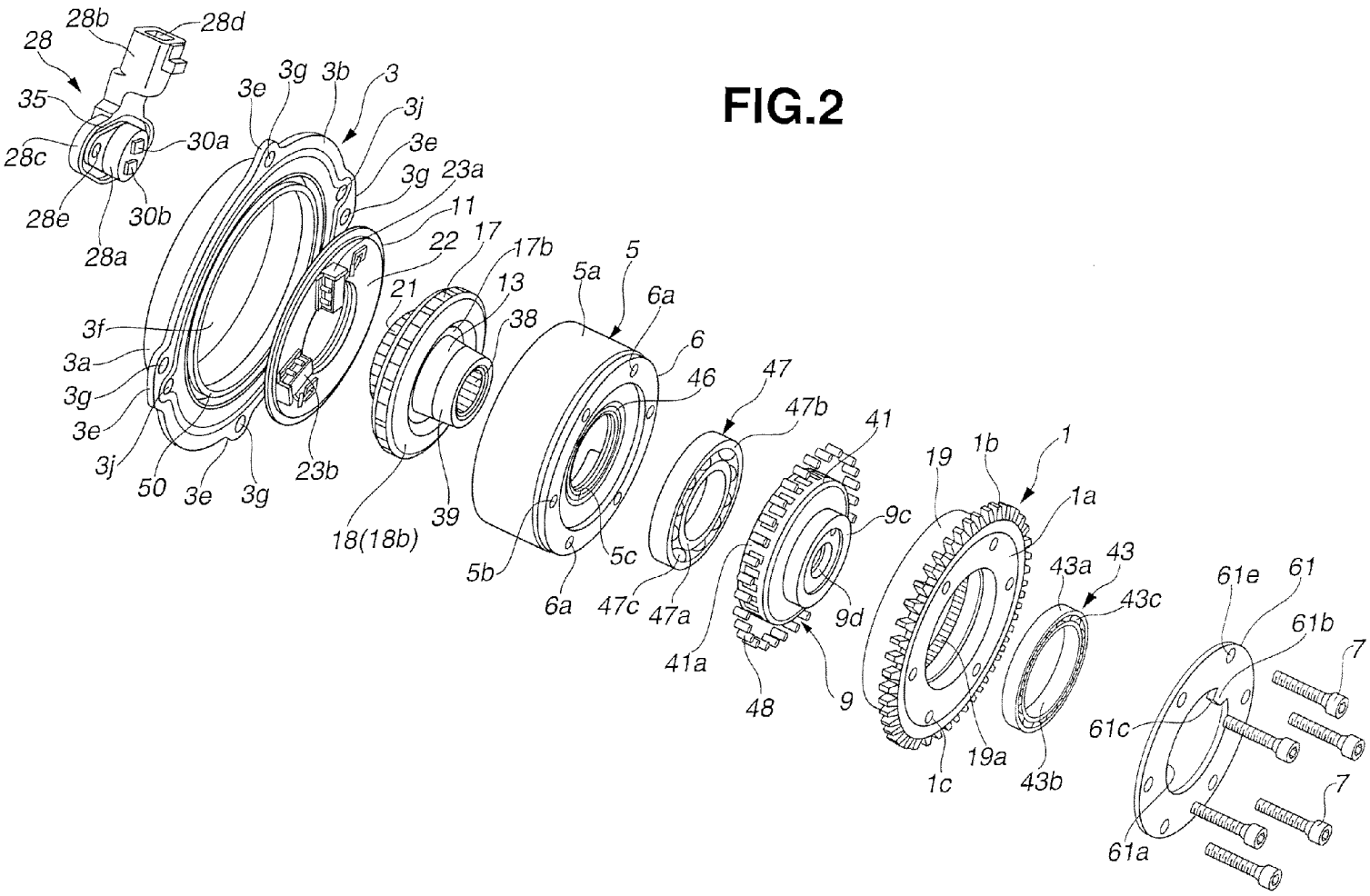
FIG. 2 is a perspective exploded view showing main components of the present embodiment.

As shown in FIGS. 1 and 2, the variable valve apparatus of the present embodiment has a timing sprocket 1 as a drive rotary member which is driven and rotates by an engine crankshaft, a camshaft 2 which is rotatably supported on a cylinder head 40 of the engine through a bearing 42 and rotates by a rotation driving force or turning force transmitted from the timing sprocket 1, and a phase-change mechanism or phase converter 4 which is covered with a cover member 3 fixed to a chain cover 49 and changes or controls a relative rotational phase (a relative rotational angle position) between the timing sprocket 1 and the camshaft 2 in accordance with an engine operating state.

The timing sprocket 1 is formed as an integral component by iron type metal, and has a ring shape. As can be seen in FIG. 2, the timing sprocket 1 has a sprocket body 1*a* whose inner circumferential surface has a stepped shape, a gear portion 1*b* formed integrally with an outer circumference of the sprocket body 1*a* and receiving a rotation driving force or turning force from the engine crankshaft with a timing chain (not shown) wound around the gear portion 1*b*, and an internal tooth forming portion (or an internal gear forming portion) 19 which is an internal tooth engagement portion formed integrally with a front end side of the sprocket body 1*a*.

Between the sprocket body 1*a* of the timing sprocket 1 and an after-mentioned driven member 9 which is an output member and is provided at a front end part of the camshaft 2, a large diameter ball bearing 43 is installed. The timing sprocket 1 and the camshaft 2 are relatively rotatably supported by this large diameter ball bearing 43.

The large diameter ball bearing 43 has an outer ring 43*a*, an inner ring 43*b* and balls 43*c* provided between the outer and inner rings 43*a* and 43*b*. The outer ring 43*a* of this large diameter ball bearing 43 is fixed to an inner circumferential side of the sprocket body 1*a*, whereas the inner ring 43*b* is fixed to an outer circumferential side of the driven member 9.

The outer ring 43*a* has an inner circumferential surface 43*d*, and this inner circumferential surface 43*d* side serves as an opening portion that communicates with the outside. The inner circumferential surface 43*d* is positioned at an outer circumferential side with respect to a maximum eccentric locus of an outer circumferential surface of an outer ring 47*b* of a middle diameter ball bearing 47 that is a part of an after-mentioned eccentric cam mechanism.

The sprocket body 1*a* has, at the inner circumferential side thereof, an outer ring fixing portion 60 which is formed into an annular groove shape by the cutting and opens to the camshaft 2 side.

This outer ring fixing portion 60 has a stepped shape. The outer ring 43*a* of the large diameter ball bearing 43 is press-fitted to this step-shaped portion from an axial direction, then positioning at one side in the axial direction of the outer ring 43*a* is made.

The internal tooth forming portion 19 is formed integrally with a front end portion of the sprocket body 1*a*, and has a relatively-thick cylindrical shape that extends toward an electric motor 12 of the phase-change mechanism 4. Further, the internal tooth forming portion 19 has, at an inner circumference thereof, a plurality of waveform internal teeth 19*a*.

Moreover, at a front end side of the internal tooth forming portion 19, an annular female screw forming part 6 formed integrally with an after-mentioned housing 5 is disposed with the female screw forming part 6 facing to the internal tooth forming portion 19.

Figure 4:
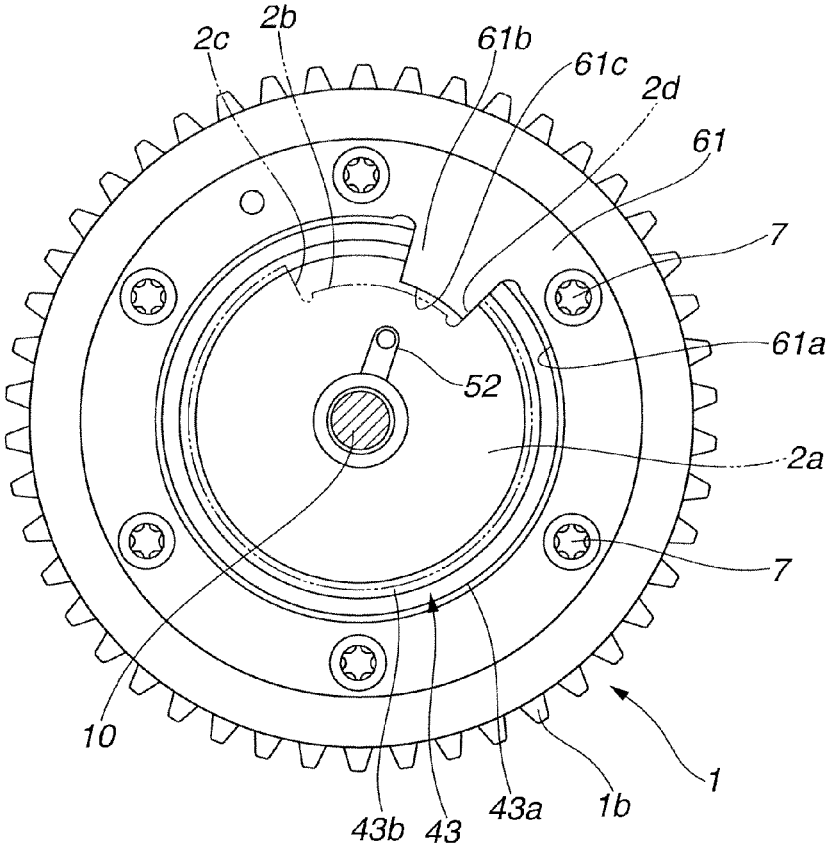
FIG. 4 is a sectional view, viewed from B-B of FIG. 1.

In addition, at a rear end portion of the sprocket body is which is an opposite side to the internal tooth forming portion 19 in the axial direction, an annular retaining plate 61 is disposed. This retaining plate 61 is formed as an integral component by a metal plate. As shown in FIG. 1, an outside diameter of the retaining plate 61 is set to be substantially same as an outside diameter of the sprocket body 1*a*. An inner circumferential part 61*a* of the retaining plate 61 touches an outer end surface 43*e* in the axial direction of the outer ring 43*a* from the axial direction by a slight pressing force, then positioning of the retaining plate 61 is made. As shown in FIGS. 2 and 4, a stopper protrusion 61*b* is formed integrally with the inner circumferential part 61*a* at a certain position of an inner circumferential edge of the inner circumferential part 61*a*. The stopper protrusion 61*b* protrudes in a radially inward direction, i.e. in a direction of a center.

As shown in FIGS. 2 and 4, this stopper protrusion 61*b* has a substantially sector or fan shape. A top end edge 61*c* of the stopper protrusion 61*b* is formed into such arc shape that the top end edge 61*c* (the retaining plate 61) slides or rotates along an arc-shaped inner peripheral surface of an after-mentioned stopper recessed groove 2*b* of the camshaft 2. Further, six bolt insertion holes 61*e* into which a bolt 7 is each inserted are formed at regular intervals in a circumferential direction at an outer peripheral side of the retaining plate 61.

As mentioned above, the retaining plate 61 is provided with the six bolt insertion holes 61*e* at regular intervals in the circumferential direction at the outer peripheral side of the retaining plate 61. Also the sprocket body 1*a* (the internal tooth forming portion 19) is provided with six bolt insertion holes is at regular intervals in the circumferential direction at an outer peripheral side of the sprocket body 1*a*. The above-described female screw forming part 6 is provided with six female screw holes 6*a* at positions corresponding to each of the bolt insertion holes 1*c* and 61*e*. The timing sprocket 1, the retaining plate 61 and the housing 5 are tightened and connected together with the six bolts 7 inserted and screwed into these holes.

Here, the sprocket body 1*a* and the internal tooth forming portion 19 serve as a casing of an after-mentioned speed reduction mechanism 8.

As seen in FIGS. 1 and 2, outside diameters of the sprocket body 1*a*, the internal tooth forming portion 19, the retaining plate 61 and the female screw forming part 6 are set to be substantially same as each other.

As shown in FIG. 1, the chain cover 49 is set along a longitudinal direction and fixed to the cylinder head 40 and a front end side of a cylinder block so as to cover the timing chain (not shown) wound around the gear portion 1*b* of the timing sprocket 1. The chain cover 49 has an opening 49*a* at a position corresponding to the phase-change mechanism 4. An annular wall 49*b* of the chain cover 49, which forms the opening 49*a*, is provided in a circumferential direction with four boss portions 49*c* that are formed integrally with the annular wall 49*b*. Then, each female screw hole 49*d* is formed from the annular wall 49*b* to an inside of the boss portion 49*c*.

As shown in FIGS. 1 and 2, the cover member 3 is formed as an integral component by aluminium alloy, and has a cup shape. More specifically, the cover member 3 has a bulging cover body 3*a* and a ring-shaped mounting flange 3*b* that is formed integrally with an outer peripheral edge, located at an opening side, of the cover body 3*a*. The cover body 3*a* is formed so as to cover a front end part of the housing 5. A cylindrical wall 3*c* that is formed integrally with the cover body 3*a* is provided at an outer peripheral side of the cover body 3*a*. This cylindrical wall 3*c* is formed in the axial direction, and has at an inner side thereof a supporting opening 3*d* that supports an after-mentioned brush retainer 28.

The mounting flange 3*b* is provided, at substantially regular intervals in a circumferential direction, with four protruding portions 3*e* where a bolt insertion hole 3*g* is formed. The cover member 3 is then fixed to the chain cover 49 by inserting a bolt 54 into the bolt insertion hole 3*g* and screwing the bolt 54 into the female screw hole 49*d* formed at the chain cover 49.

As shown in FIGS. 1 and 2, an inner circumferential surface of the cover body 3*a*, located at a border with the mounting flange 3*b*, has a stepped portion. Then, between this stepped portion of the cover body 3*a* and an outer circumferential surface of the housing 5, a large diameter oil seal 50 is fitted. This large diameter oil seal 50 has an almost square bracket ("]") shape in cross section. A base material of the large diameter oil seal 50 is a synthetic rubber, and a core metal is embedded in the synthetic rubber base material. A ring-shaped base portion at an outer circumferential side of the large diameter oil seal 50 is fitted into and fixed to a stepped annular portion 3*f* formed on the inner circumferential surface of the cover member 3. By the large diameter oil seal 50, leakage or entry of the lubricating oil, which scatters during rotation of the timing sprocket 1 etc., into an inside of the electric motor 12 (described later) is suppressed.

The housing 5 has a housing body 5*a* that is a tubular portion formed into a bottomed cylindrical shape by the press forming of iron type metal and a sealing plate 11 that is formed from non-magnetic material of synthetic resin and seals or closes a front end opening of the housing body 5*a*.

The housing body 5*a* has a discoid bulkhead or partition wall 5*b* and a protruding portion 5*d* at a rear end side of the housing body 5*a*. The discoid partition wall 5*b* is provided, in the middle thereof, with a large diameter shaft part insertion hole 5*c* into which an after-mentioned eccentric shaft part 39 is inserted. The protruding portion 5*d* is formed integrally with a hole edge of the shaft part insertion hole 5*c*, and has a cylindrical shape that protrudes toward the cover member 3.

The partition wall 5*b* is formed relatively thin, and has a hollow or recessed shape in cross section so as to cover one side in the axial direction of a coil 18 of the electric motor 12 (described later). The above-mentioned thick annular female screw forming part 6 is formed integrally with an outer circumferential side of a rear end surface of the partition wall 5*b*.

The camshaft 2 has, at an outer periphery thereof, two rotation cams per cylinder, each of which actuates an intake valve (not shown). Further, a flange part 2*a* is formed integrally with a front end portion of the camshaft 2. The rotation cam has a typical oval shape, and actuates the intake valve against a spring force of a valve spring through a valve lifter.

As shown in FIG. 1, this flange part 2*a* is formed so that its outside diameter is slightly greater than an outside diameter of a fixed end part 9*a* of the driven member 9. More specifically, the flange part 2*a* is set so that an outer circumference of a front end surface of the flange part 2*a* touches or is contiguous to an axial direction outer end surface of the inner ring 43*b* of the large diameter ball bearing 43 after assembly of each component. Then, the camshaft 2 and the driven member 9 are connected together in the axial direction with a cam bolt 10 with the front end surface of the flange part 2*a* being contiguous to the driven member 9 from the axial direction.

As shown in FIG. 4, the flange part 2*a* is provided, at the outer circumference thereof, with the stopper recessed groove 2*b*. The stopper recessed groove 2*b* is formed along the circumferential direction of the flange part 2*a*, and the stopper protrusion 61*b* of the retaining plate 61 is inserted in the stopper recessed groove 2*b* and slides or rotates along the circumferential direction. This arc-shaped stopper recessed groove 2*b* has a predetermined length in the circumferential direction, and both edges of the stopper protrusion 61*b* rotating within a range of this length in the circumferential direction touch respective opposing edges 2*c* and 2*d*, thereby limiting the rotational angle position of the camshaft 2 relative to the timing sprocket 1 to a most-advanced angle side and a most-retarded angle side.

Here, the stopper protrusion 61*b* is set so as to be bent to the rotation cam side of the camshaft 2 with respect to the inner circumferential part 61*a* of the retaining plate 61 which is pressed against the outer ring 43*a* of the large diameter ball bearing 43 from the axial direction outer side, then the stopper protrusion 61*b* and the fixed end part 9*a* of the driven member 9 are brought in a non-contact state. With this structure, interference with the fixed end part 9*a* (i.e. contact of the stopper protrusion 61*b* and the fixed end part 9*a*) can be suppressed.

The stopper protrusion 61*b* and the stopper recessed groove 2*b* form a stopper mechanism.

As shown in FIG. 1, the cam bolt 10 has a bolt head 10*a* and a shaft part 10*b*. An edge surface 10*c*, located at the shaft part 10*b* side, of the bolt head 10*a* touches an inner ring of an after-mentioned small diameter ball bearing 37 from the axial direction. A male screw part is formed at an outer periphery of the shaft part 10*b*, and this male screw part is screwed in a female thread that is formed inside the camshaft 2 from the end portion of the camshaft 2 in the axial direction.

The driven member 9 is formed as an integral component by iron type metal. As shown in FIG. 1, the driven member 9 has the disc-shaped fixed end part 9*a* at the rear end side of the driven member 9, a cylindrical portion 9*b* that protrudes from an inner peripheral front end surface of the fixed end part 9*a* in the axial direction, and a cylindrical retainer 41 that is a retaining member formed integrally with an outer circumference of the fixed end part 9*a* and retaining a plurality of rollers 48.

The driven member 9 is fixed to the camshaft 2 with a rear end surface of the fixed end part 9*a* being contiguous to and press-fitted to the front end surface of the flange part 2*a* of the camshaft 2 from the axial direction by an axial force of the cam bolt 10.

The cylindrical portion 9*b* is provided, in the middle thereof, with an insertion hole 9*d* into which the shaft part 10*b* of the cam bolt 10 is inserted. The cylindrical portion 9*b* is also provided, at an outer circumferential side thereof, with a needle bearing ring 38.

Figure 3:
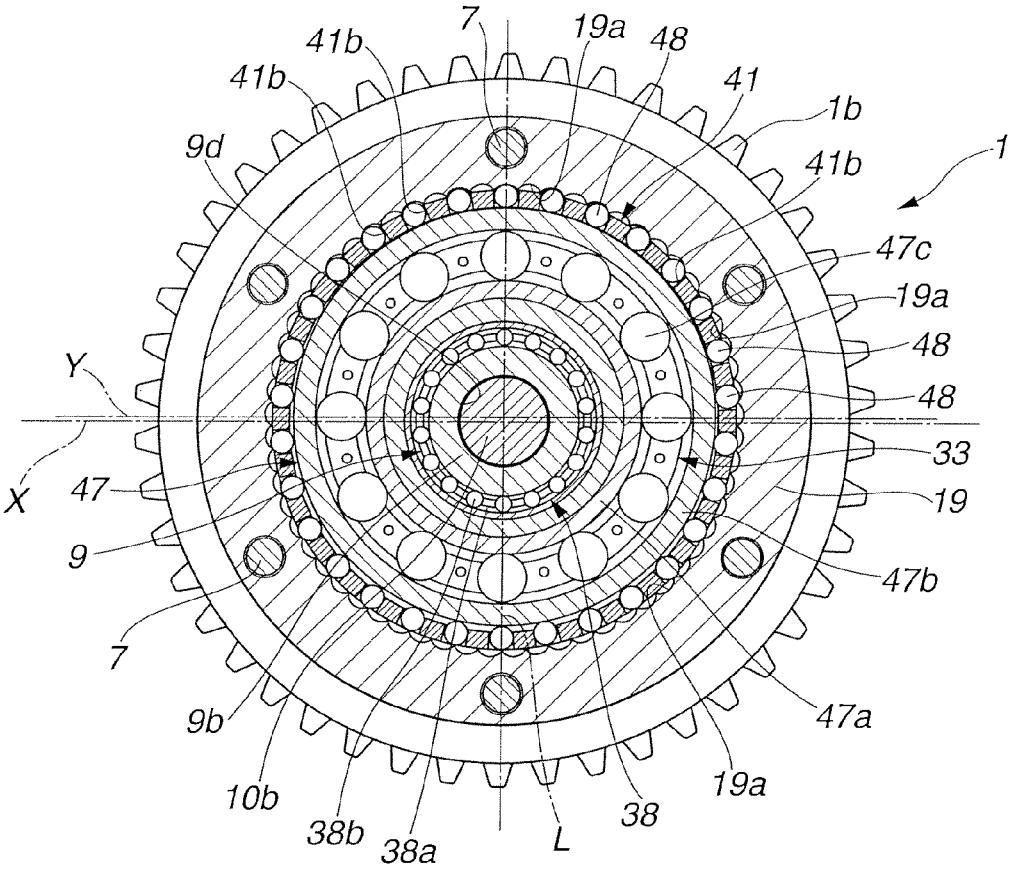
FIG. 3 is a sectional view, viewed from A-A of FIG. 1.

As shown in FIGS. 1 to 3, the retainer 41 is shaped like a square bracket ("]") shape in longitudinal cross section by being bent from the outer circumference front end of the fixed end part 9*a*, and has a bottomed cylindrical shape protruding in the same direction as the cylindrical portion 9*b*. A tubular or cylindrical top end portion 41*a* of the retainer 41 extends toward the partition wall 5*b* of the housing 5 through a space 44 that is a ring-shaped recessed portion formed between the female screw forming part 6 and the protruding portion 5*d*. Further, a plurality of substantially rectangular roller retaining holes 41*b* are formed at regular intervals in a circumferential direction of the cylindrical top end portion 41*a*. The retaining holes 41*b* are roller retaining portions that retain a plurality of the rollers 48 so that each roller 48 can roll. The number of the all retaining holes 41*b* (the rollers 48) is set to be less than that of the internal teeth 19*a* of the internal tooth forming portion 19 by one.

As can be seen in FIGS. 1 and 2, between the outer circumference of the fixed end part 9*a* and a bottom side connecting portion of the retainer 41, an inner ring fixing portion 63 for fixing the inner ring 43*b* of the large diameter ball bearing 43 is formed by the cutting.

More specifically, this inner ring fixing portion 63 is formed into a stepped shape at a position opposite to the outer ring fixing portion 60 in the radial direction. The inner ring fixing portion 63 has an annular outer circumferential surface that extends in the axial direction of the camshaft 2 and a second fixing stepped surface that is formed integrally with the annular outer circumferential surface along the radial direction. The inner ring 43*b* of the large diameter ball bearing 43 is press-fitted to the outer circumferential surface from the axial direction, and an inner end surface of the press-fitted inner ring 43*b* is contiguous to the second fixing stepped surface, thereby achieving the positioning in the axial direction of the large diameter ball bearing 43.

The phase-change mechanism 4 has the electric motor 12 which is substantially coaxially aligned with the camshaft 2 at a front end side of the camshaft 2 and the speed reduction mechanism 8 which reduces a rotation speed of the electric motor 12 and transmits it to the camshaft 2. The electric motor 12 and the speed reduction mechanism 8 are set with these electric motor 12 and speed reduction mechanism 8 being adjacent to each other.

The electric motor 12 is a brush DC motor. As shown in FIGS. 1 and 2, the electric motor 12 has the housing body 5*a* that is a yoke rotating integrally with the timing sprocket 1, a motor output shaft 13 that is rotatably provided inside the housing body 5*a*, a pair of semi-arc permanent magnets 14 and 15 that are stators secured to an inner peripheral surface of the housing body 5*a*, and a stator 16 that is secured to the sealing plate 11.

The motor output shaft 13 is formed into a stepped cylindrical shape, and functions as an armature. The motor output shaft 13 has a large diameter portion 13*a* positioned at the camshaft 2 side, a small diameter portion 13*b* positioned at the brush retainer 28 side and a stepped portion 13*c* positioned in a midpoint in the axial direction of the motor output shaft 13.

An iron-core rotor 17 is secured to an outer periphery of the large diameter portion 13*a*. Further, the eccentric shaft part 39 is formed integrally with a rear end portion of the large diameter portion 13*a*.

On the other hand, a ring-shaped member 20 is press-fitted onto and fixed to an outer periphery of the small diameter portion 13*b*. Further, a commutator 21 is press-fitted onto and fixed to an outer peripheral surface of the ring-shaped member 20 from the axial direction. A position, in the axial direction, of the ring-shaped member 20 (the commutator 21) is fixed by an axial direction end surface of the stepped portion 13*c*. An outside diameter of the ring-shaped member 20 is set to be the substantially same as an outside diameter of the large diameter portion 13*a*. An axial direction length of the ring-shaped member 20 is set to be slightly shorter than that of the small diameter portion 13*b*.

A plug member or stopper 55 is press-fitted to an inner peripheral surface of the small diameter portion 13*b*. By this plug member 55, leakage or entry of the lubricating oil, which is provided at inner sides of the motor output shaft 13 and the eccentric shaft part 39 and lubricates the small diameter ball bearing 37 and the needle bearing ring 38, into the inside of the electric motor 12 is suppressed.

The iron-core rotor 17 is formed by magnetic member having a plurality of magnetic poles. The iron-core rotor 17 has, at an outer circumferential side thereof, a bobbin having a slot where a wire of the coil 18 is wound. The coil 18 is disposed at a position close to the partition wall 5*b* of the housing 5 with the coil 18 housed in the hollow or recessed portion of the partition wall 5*b*.

The commutator 21 is formed by conductive material, and has a ring shape. A terminal (not shown) of the wire drawn from the coil 18 is electrically connected to each of segments of the commutator 21 which are divided into the same number as that of the magnetic poles of the iron-core rotor 17. That is, each top end of the terminal of the coil wire is sandwiched at a folded-portion formed at an inner circumferential side of the iron-core rotor 17, then the electrical connection is made.

Each of the permanent magnets 14 and 15 has a cylindrical shape, and has a plurality of magnetic poles in the circumferential direction. As can be seen in FIG. 1, a position in the axial direction of each of the permanent magnets 14 and 15 is offset forward (toward a left hand side in FIG. 1) from a fixed position of the iron-core rotor 17. With this arrangement, front end portions of the permanent magnets 14 and 15 radially overlap the commutator 21 and after-mentioned first brushes 25*a* and 25*b* (see FIGS. 1 and 5) of the stator 16.

Figure 5:
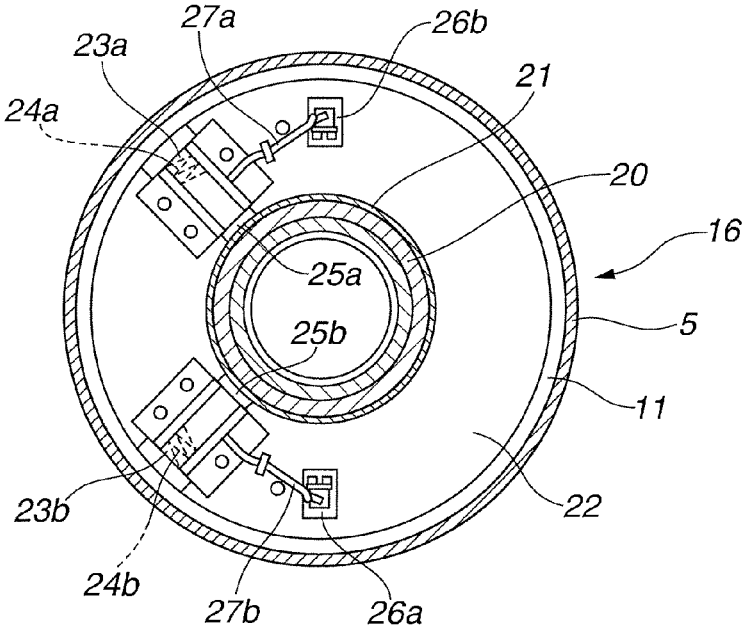
FIG. 5 is a sectional view, viewed from C-C of FIG. 1.

The stator 16 has, as shown in FIG. 5, a disc-shaped resin plate 22 formed integrally with an inner peripheral side of the sealing plate 11, a pair of resin holders 23*a*, 23*b* provided on an inner side of the resin plate 22, the a pair of first brushes 25*a*, 25*b*, inside-outside-double ring-shaped slip rings 26*a*, 26*b* embedded in and fixed to front end surfaces of the resin holders 23*a*, 23*b* with each outer end surface of the slip rings 26*a*, 26*b* exposed, and pigtail harnesses 27*a*, 27*b* electrically connecting the first brushes 25*a*, 25*b* and the slip rings 26*a*, 26*b* respectively. The first brushes 25*a*, 25*b* are switching brushes (commutators), and are housed in the resin holders 23*a*, 23*b* so as to be able to slide along the radial direction. Each top end surface of the first brushes 25*a*, 25*b* makes elastic contact with the outer circumference of the commutator 21 from the radial direction by spring forces of coil springs 24*a*, 24*b*.

Here, the slip rings 26*a*, 26*b* form a part of a power feed mechanism. The first brushes 25*a*, 25*b*, the commutator 21 and the pigtail harnesses 27*a*, 27*b* etc. form a current switching mechanism (or a current switching unit).

A position of the sealing plate 11 is fixed by a recessed stepped portion that is formed at the front end part inner periphery of the housing 5, then the sealing plate 11 is fixed to the front end part inner periphery of the housing 5 by the crimping. The sealing plate 11 is provided, in the middle thereof, with a shaft insertion hole 11*a* into which one end portion of the motor output shaft 13 is inserted.

The brush retainer 28 molded as an integral component by synthetic resin material, which is the power feed mechanism, is fixed to the cover body 3*a*. As shown in FIGS. 1 and 2, this brush retainer 28 has an L-shape when viewed from a side. The brush retainer 28 has a substantially cylindrical brush retaining part 28*a* that is inserted into the supporting opening 3*d*, a connector part 28*b* that is positioned at an upper end portion of the brush retaining part 28*a*, a pair of brackets 28*c*, 28*c* that are formed integrally with both sides of the brush retaining part 28*a* and fixed to the cover body 3*a*, and a pair of terminal parts 31, 31, most of which are embedded in the brush retainer 28.

The pair of terminal parts 31, 31 are arranged parallel to each other in up-and-down direction, and has a crank-shape. Terminals 31*a*, 31*a* provided at one side (a lower end side) are located at a bottom side of the brush retaining part 28*a* with each terminal 31*a* exposed. Terminals 31*b*, 31*b* provided at the other side (an upper end side) are formed in a female fitting groove 28*d* of the connector part 28*b*. The other side terminals 31*b*, 31*b* are electrically connected to a battery power via a male terminal (not shown).

As shown in FIG. 1, the brush retaining part 28*a* extends in a horizontal direction (in the axial direction), and sleeve-shaped sliding parts 29*a*, 29*b* are fixed in a cylindrical penetration opening that is formed at up-and-down position inside the brush retaining part 28*a*. Second brushes 30*a*, 30*b* are held in the sliding parts 29*a*, 29*b* so as to be able to slide in the axial direction. Top end surfaces of these second brushes 30*a*, 30*b* touch or are contiguous to the slip rings 26*a*, 26*b* respectively from the axial direction by the sliding movement of the second brushes 30*a*, 30*b*.

Each of the second brushes 30*a*, 30*b* is formed into a substantially rectangular parallelepiped. The second brushes 30*a*, 30*b* are respectively forced toward the slip rings 26*a*, 26*b* by spring forces of second coil springs 32*a*, 32*b* that are elastically installed between the one side terminals 31*a*, 31*a* and the second brushes 30*a*, 30*b*.

As shown in FIG. 1, a pair of bendable pigtail harnesses 33*a*, 33*b* are fixed between rear end portions of the second brushes 30*a*, 30*b* and the one side terminals 31*a*, 31*a* by the welding, then both of the second brushes 30*a*, 30*b* and the one side terminals 31*a*, 31*a* are electrically connected to each other. Each length of the pigtail harnesses 33*a*, 33*b* is set to such length that when the second brushes 30*a*, 30*b* move forward (toward a right hand side in FIG. 1) to the maximum by the coil springs 32*a*, 32*b*, the second brushes 30*a*, 30*b* do not come out or fall out of the sliding parts 29*a*, 29*b*. That is, each length of the pigtail harnesses 33*a*, 33*b* is set to the length that limits a maximum sliding position of each of the second brushes 30*a*, 30*b*.

Further, a ring-shaped seal member 34 is fitted and supported in an annular fitting groove formed at a base side outer periphery of the brush retaining part 28*a*. Then when the brush retaining part 28*a* is inserted into the supporting opening 3*d*, the seal member 34 seals an inside of the brush retainer 28 with the seal member 34 making elastic contact with a top end surface of the cylindrical wall 3*c* of the cover member 3.

The male terminal (not shown) is inserted and fitted into the female fitting groove 28*d* at the upper end side. The other side terminals 31*b*, 31*b*, positioned in the female fitting groove 28*d*, of the connector part 28*b* are then electrically connected to a control unit (a controller) 56 via the male terminal.

Each of the brackets 28*c*, 28*c* is formed into a substantially triangle, as shown in FIG. 2. The brackets 28*c*, 28*c* have, at both ends thereof, bolt insertion holes 28*e*, 28*e*. Bolts (not shown) are screwed into a pair of female screw holes (not shown) that are formed at the cover body 3*a*. The brush retainer 28 is fixed to the cover body 3*a* through the brackets 28*c*, 28*c* with the bolts inserted into the bolt insertion holes 28*e*, 28*e* and screwed into the female screw holes.

The small diameter ball bearing 37 is provided on the outer peripheral surface, at the bolt head 10*a* side, of the shaft part 10*b* of the cam bolt 10. The motor output shaft 13 and the eccentric shaft part 39 are rotatably supported by this small diameter ball bearing 37 and the needle bearing ring 38 provided on the outer circumferential surface of the cylindrical portion 9*b* of the driven member 9 and positioned at a side in the axial direction of the small diameter ball bearing 37.

An inner ring 37*a* of the small diameter ball bearing 37 is sandwiched and fixed between a stepped front end edge of the cylindrical portion 9*b* of the driven is member 9 and a bolt head edge surface 10*c* of the cam bolt 10. An outer ring 37*b* of the small diameter ball bearing 37 is press-fitted and fixed to an inner peripheral surface of the motor output shaft 13 at a position close to the stepped portion 13*c*, and also is contiguous to an inner side stepped surface of the stepped portion 13*c*. Positioning in the axial direction of the small diameter ball bearing 37 is then made.

The needle bearing ring 38 has a cylindrical retainer 38*a* press-fitted to an inner peripheral surface of the eccentric shaft part 39 and a needle roller 38*b* having a plurality of rollers, each of which is held and rolls in the retainer 38*a*. One end in the axial direction of the retainer 38*a* touches or is contiguous to an opposing side surface of the outer ring 37*b* of the small diameter ball bearing 37. The needle roller 38*b* rolls on an outer circumferential surface of the cylindrical portion 9*b* of the driven member 9.

As shown in FIG. 1, a small diameter oil seal 46 is provided between the outer peripheral surface of the motor output shaft 13 (the eccentric shaft part 39) and an inner peripheral surface of the protruding portion 5*d* of the housing 5. The small diameter oil seal 46 prevents leakage of the lubricating oil (or restricts entry of the lubricating oil) from an inside of the speed reduction mechanism 8 into the inside of the electric motor 12. The small diameter oil seal 46 has a base portion 46*a* which is fixed to the inner peripheral surface of the protruding portion 5*d*, a seal portion 46*b* which is formed integrally with an inner peripheral portion of the base portion 46*a* and whose inner circumference makes sliding-contact with the outer peripheral surface of the large diameter portion 13*a* of the is motor output shaft 13, and a backup spring which forces the seal portion 46*b* in a direction of the outer peripheral surface of the large diameter portion 13*a*. The small diameter oil seal 46 is disposed from the axial direction and positioned close to the coil 18 through the protruding portion 5*d*.

The control unit 56 is configured to detect a current engine operating state on the basis of information signals from sensors such as a crank angle sensor, an airflow meter, an engine coolant temperature sensor for detecting an engine coolant temperature, an engine oil temperature sensor for detecting an engine oil temperature (for detecting a lubricating oil temperature) and an accelerator opening sensor (all, not shown) then execute an engine control. Also the control unit 56 performs a rotation control of the motor output shaft 13 by outputting a control current to the coil 18 through the connector terminal 31*b* and the second brushes 30*a*, 30*b* etc.

The control unit 56 has an engine start indication detecting circuit 57 as an engine start indication detecting unit which detects, for instance, a lock release state of a door of a vehicle.

This engine start indication detecting circuit 57 is configured to, when a door lock releasing operation is done in a state in which the engine coolant temperature detected by the engine coolant temperature sensor is a low temperature that is less than or equal to a predetermined temperature after an engine stop, detect this release signal and start energizing the coil 18 of the electric motor 12 then maintain this energization until an engine cranking starts.

Besides the vehicle door lock release signal, the engine start indication detecting circuit 57 can energize the coil 18 by detecting an occurrence before the engine start (before the engine cranking) by a driver, for instance, by detecting a door open signal e.g. an open signal of a trunk lid.

The speed reduction mechanism 8 mainly has, as shown in FIGS. 1 and 2, the eccentric shaft part 39 eccentrically rotating, the middle diameter ball bearing 47 provided at an outer periphery of the eccentric shaft part 39, the rollers 48 provided at an outer circumference of the middle diameter ball bearing 47, the retainer 41 allowing a radial movement of the rollers 48 while retaining the rollers 48 in a rolling direction, and the driven member 9 with which the retainer 41 is formed integrally. The eccentric cam mechanism is formed by the eccentric shaft part 39 and the middle diameter ball bearing 47.

The eccentric shaft part 39 is formed into a cylindrical shape having a step. A front end side of the eccentric shaft part 39 is integrally formed with or connected to the large diameter portion 13*a* of the motor output shaft 13 from the axial direction. An axial center Y of a cam surface 39*a* that is formed on an outer circumferential surface of the eccentric shaft part 39 is set at a position slightly eccentric to an axial center X of the motor output shaft 13 in the radial direction.

The middle diameter ball bearing 47 is disposed so as to almost entirely overlap the needle bearing ring 38 in the radial direction. The middle diameter ball bearing 47 is has an inner ring 47*a*, an outer ring 47*b* and balls 47*c* provided between the inner and outer rings 47*a* and 47*b*. The inner ring 47*a* is press-fixed to the cam surface 39*a* of the eccentric shaft part 39, whereas the outer ring 47*b* is in a free state without being fixed in the axial direction. That is, one end surface in the axial direction, at the electric motor 12 side, of this outer ring 47*b* does not touch any part, also a small gap is provided between the other end surface in the axial direction of the outer ring 47*b* and an inside surface of the opposing retainer 41.

Further, an outer peripheral surface of each of the rollers 48 is contiguous to an outer circumferential surface of the outer ring 47*b* so as to be able to roll. Also a ring-shaped gap is provided at the outer circumferential side of this outer ring 47*b*. That is, by this ring-shaped gap, the whole of the middle diameter ball bearing 47 can move in the radial direction with and by an eccentric rotation of the eccentric shaft part 39, namely that an eccentric movement of the middle diameter ball bearing 47 becomes possible.

The rollers 48 are formed by iron type metal. Each of the rollers 48 is fitted to the internal teeth 19*a* of the internal tooth forming portion 19 while moving in the radial direction with and by the eccentric movement of the middle diameter ball bearing 47. Each of the rollers 48 also wobbles in the radial direction while being guided in the circumferential direction by both side edges of the roller retaining holes 41*b* of the retainer 41.

The speed reduction mechanism 8 is supplied with the lubricating oil by a lubricating oil supplying mechanism. This lubricating oil supplying mechanism has an oil supply passage which is formed at an inside of the bearing 42 of the cylinder head 40 and is supplied with the lubricating oil from a main oil gallery (not shown), and as shown in FIG. 1, an oil supply hole 51 which is formed in the axial direction in the camshaft 2 and communicates with the oil supply passage through a groove, and a small diameter oil hole 52 which penetrates the driven member 9 in the axial direction and whose one end opens to the oil supply hole 51 through a ring-shaped passage and whose other end opens to an area close to the needle bearing ring 38 and the middle diameter ball bearing 47.

The lubricating oil is supplied in the space 44 by the lubricating oil supplying mechanism, and the middle diameter ball bearing 47 and each roller 48 are lubricated. Further, the lubricating oil flows to insides of the eccentric shaft part 39 and the motor output shaft 13, then lubricates movable parts or elements such as the needle bearing ring 38 and the small diameter ball bearing 37. Here, leakage of the lubricating oil, which is supplied in the space 44, into the housing 5 is prevented by the small diameter oil seal 46.

As mentioned above, the electric motor 12 and the speed reduction mechanism 8 are adjacent to each other, and this arrangement includes a structure in which the electric motor 12 and the speed reduction mechanism 8 are fixedly connected to each other. The motor output shaft 13 (the eccentric shaft part 39) is inserted into the speed reduction mechanism 8, and the housing body 5*a* of the electric motor 12 is fixedly connected to the sprocket body 1*a* that is the casing of the speed reduction mechanism 8.

Working and Operation of the Present Embodiment

Next, working and operation of the present embodiment will be explained. When the crankshaft of the engine rotates, the timing sprocket 1 rotates through the timing chain, and the housing 5, i.e. the electric motor 12 rotates in synchronization with the engine crankshaft and the timing sprocket 1 with the turning force of the timing sprocket 1 transmitted to the housing 5 through the internal tooth forming portion 19 and the female screw forming part 6. On the other hand, the turning force of the internal tooth forming portion 19 is transmitted to the camshaft 2 through each of the rollers 48, the retainer 41 and the driven member 9. With this working, the rotation cam of the camshaft 2 actuates (opens and closes) the intake valve.

In a certain engine operating state after an engine start, the control unit 56 flows the current to the coil 18 of the electric motor 12 through the terminal parts 31, 31, the pigtail harnesses 33*a*, 33*b*, the second brushes 30*a*, 30*b* and the slip rings 26*a*, 26*b* etc. The motor output shaft 13 is then driven and rotates, and this turning force is transmitted to the camshaft 2 through the speed reduction mechanism 8 with the rotation reduced.

That is, when the eccentric shaft part 39 eccentrically rotates with and by the rotation of the motor output shaft 13, each of the rollers 48 gets over one certain internal tooth 19*a* of the internal tooth forming portion 19 and moves to the other adjacent internal tooth 19*a* while rolling and being radially guided by each roller retaining hole 41*b* of the retainer 41 every one rotation of the motor output shaft 13. The rollers 48 rotate in the circumferential direction while rolling and moving to the adjacent internal tooth 19*a* successively or one by one. By this rotation (the rolling and the moving) of each of the rollers 48, the turning force of the motor output shaft 13 is transmitted to the driven member 9 with the rotation of the motor output shaft 13 reduced. Here, a speed reducing ratio at this time can be arbitrarily set in accordance with the number of the rollers 48 etc.

With this operation, the camshaft 2 relatively rotates in forward and reverse directions with respect to the timing sprocket 1, then the relative rotational phase is converted, thereby achieving a conversion control of opening and closing timing of the intake valve to the advanced angle side or the retarded angle side. As a result, opening and closing timing of the intake valve is controlled or changed to the most-advanced angle side or the most-retarded angle side, then fuel economy and output of the engine can be enhanced.

Here, the rotational angle position of the camshaft 2 relative to the timing sprocket 1 to the most-advanced angle side or the most-retarded angle side is limited by the fact that one side and the other side of the stopper protrusion 61*b* touch respective opposing surfaces (the respective opposing edges) 2*c* and 2*d* of the stopper recessed groove 2*b*.

Further, in the present embodiment, for instance, in a case where a long time elapses after the engine stop and the engine is in a state in which an engine temperature before the engine start is less than or equal to the predetermined temperature, for instance, when the driver performs the door lock releasing operation to start the engine, the engine start indication detecting circuit 57 detects this lock release signal and immediately outputs a signal for starting energizing the coil 18 of the electric motor 12 through the control unit 56.

Figure 6:
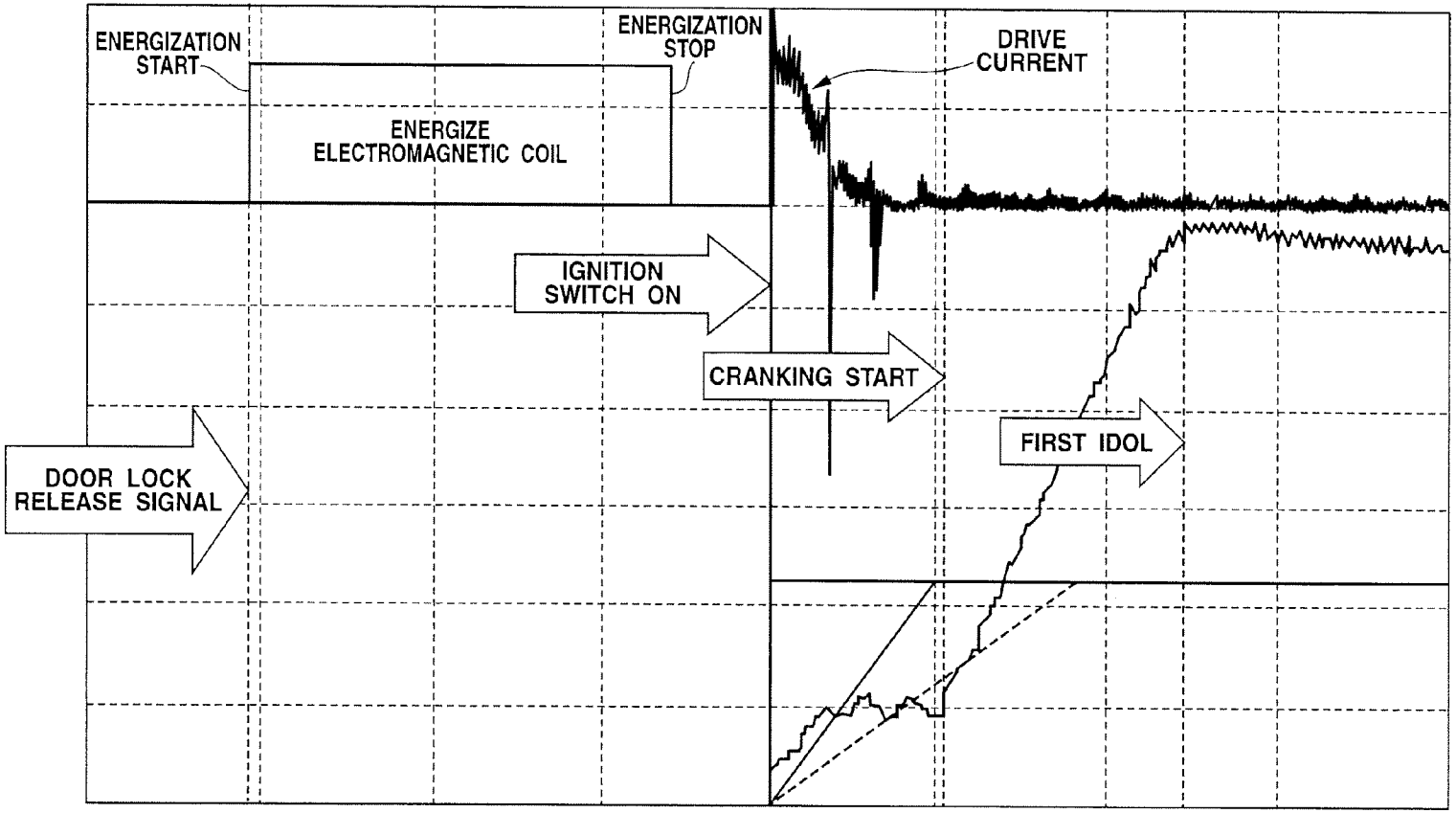
FIG. 6 is a time chart showing operation of the present embodiment.

That is, as shown in a time chart of FIG. 6, the engine start indication detecting circuit 57 detects the door lock release signal that is an indication or a sign of the engine start and outputs the release signal to the control unit 56, then the energization of the coil 18 (or current supply to the coil 18) is started by the control unit 56. This energization duration time (a current supply duration time) continues up to a time just before an ignition switch ON operation for the engine start. Normally, the energization duration time is about 10 to 20 sec. When this energization time (a current supply time) elapses, the energization of the coil 18 is stopped. An energization amount of the coil 18 is such current amount as not to rotate and drive the motor output shaft 13.

Subsequently, when the ON operation of the ignition switch is done, the current supply is initialized. Although the current is supplied to the coil 18 of the electric motor 12 again from the control unit 56, this current is a current for rotating and driving the motor output shaft 13. By this rotation and drive of the motor output shaft 13, the speed reduction mechanism 8 is operated, and the camshaft 2 relatively rotates in forward and reverse directions with respect to the timing sprocket 1, then the rotational angle position of the camshaft 2 relative to the timing sprocket 1 is converted to a middle phase position, which is suitable for the engine start, between the most-advanced angle and the most-retarded angle. Afterwards, the engine cranking starts.

Here, although the energization of the coil 18 (the current supply to the coil 18) from the control unit 56 after the engine start indication detecting circuit 57 detects the door lock release signal is maintained for a certain time, the current supply is stopped after the engine cranking starts. Then, after that, as mentioned above, in accordance with the engine operating state, a normal current for operating the phase-change mechanism 4 is supplied to the coil 18 from the control unit 56.

As described above, by supplying the current to the coil 18 for a predetermined time before the engine start, the coil 18 is heated by heat generation and the small diameter oil seal 46 is heated by heat transfer to the partition wall 5*b*. Also each roller 48 and the middle diameter ball bearing 47 of the speed reduction mechanism 8 are heated. Then, the lubricating oil supplied or stored inside is heated through these components, thereby increasing the working or operating response of the speed reduction mechanism 8.

That is, in the state in which the engine temperature is low, the inner peripheral side seal portion 46*b*, formed by rubber or elastic material, of the small diameter oil seal 46 hardens and its flexibility is decreased. Further, since the seal portion 46*b* is forced in a direction in which the seal portion 46*b* shrinks (i.e. in a radially inward direction) by the spring force of the backup spring, a strength of tightening or fastening force of the seal portion 46*b* onto the outer peripheral surface of the motor output shaft 13 increases. For this reason, in an early stage of the engine cranking, friction between the small diameter oil seal 46 and the outer peripheral surface of the motor output shaft 13 increases, then an immediate rotation of the motor output shaft 13 cannot be obtained. Moreover, viscosity of the lubricating oil in the speed reduction mechanism 8 becomes high in the low temperature state, then movability (moving performance) of the middle diameter ball bearing 47 etc. is deteriorated due to the high viscous drag. Furthermore, the lubricating oil adheres to the seal portion 46*b* of the small diameter oil seal 46, and this high viscosity also affects the rotation of the motor output shaft 13 and the movability of the middle diameter ball bearing 47.

Thus, in the present embodiment, as explained above, by the fact that the small diameter oil seal 46 is heated through the partition wall 5*b* by the heat generation of the coil 18 by the current supply to the coil 18, the flexibility of the small diameter oil seal 46 can be immediately recovered, and the viscosity of the lubricating oil in the speed reduction mechanism 8 can be immediately lowered. Here, when the current supply to the coil 18 continues for 5 sec. or more, the coil 18 is immediately heated up to about 40° C. Therefore, it is possible to heat each component and the lubricating oil in a short time.

Accordingly, as shown at a lower side in FIG. 6, regarding a conversion speed of the relative rotational phase of the camshaft 2 by the phase-change mechanism 4 at the engine start, in a case of a related art (a broken line) where no current is previously supplied to the coil 18, when the current supply to the coil 18 is started to drive the electric motor 12 from a cranking start point, a start-up speed (time) required for the drive is about 8 sec., then the drive is started. In contrast to this, in the case of the present embodiment (a solid line) where the current is previously supplied to the coil 18, the start-up speed (time) required for the drive is about 2 sec., and the drive is started in an extremely short time. Hence, good operating response of the phase-change mechanism 4 (VTC) is obtained, then engine startability can be improved.

As described above, in the present embodiment, the coil 18 is energized (the current is supplied to the coil 18) and is heated before the engine cranking start by the detection of the engine start indication by the engine start indication detecting circuit 57, and the flexibility of the small diameter oil seal 46 is recovered and the viscosity of the lubricating oil is lowered. With this operation, the friction between the small diameter oil seal 46 and the motor output shaft 13 and friction of each component of the speed reduction mechanism 8 can be reduced.

Figure 7:
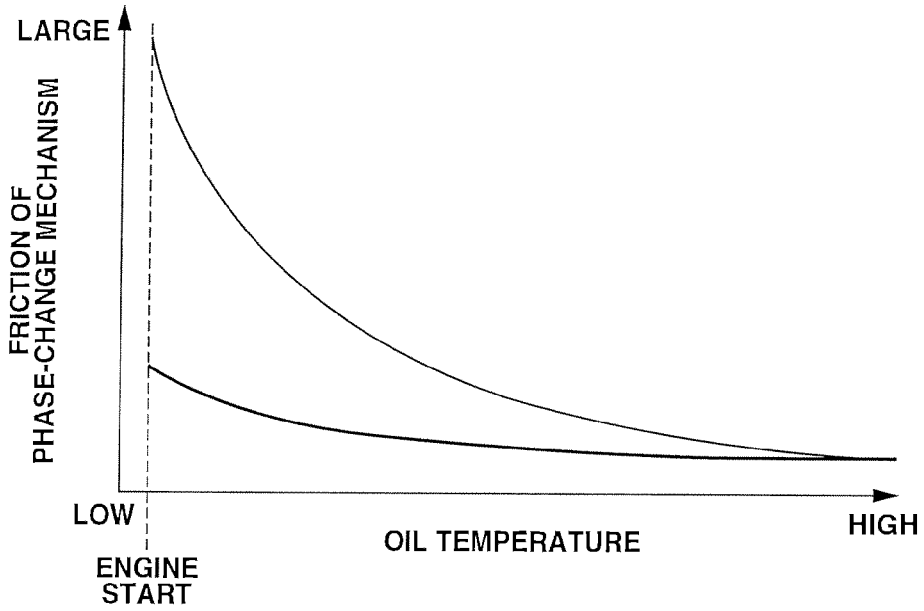
FIG. 7 is a graph showing a characteristic between lubricating oil temperature and friction of the present embodiment and a related art variable valve apparatus.

FIG. 7 is a verification result obtained by experiment which shows a relationship between the temperature of the lubricating oil in the speed reduction mechanism 8 and the friction of the phase-change mechanism 4 (the speed reduction mechanism 8). When comparing the case of the related art (a thin solid line) where no current is previously supplied to the coil 18 and the case of the present embodiment (a heavy solid line) where the current is previously supplied to the coil 18, both frictions are reduced with increase in the lubricating oil temperature when a certain time elapses after the engine start. However, in an early stage of the engine start, while the friction of the lubricating oil of the related art is large, the friction of the lubricating oil of the present embodiment is sufficiently small. This is caused by a great difference of the viscosity of the lubricating oil by the presence or absence of the current supply to the coil 18.

In the present embodiment, since an occurrence of the large friction caused by the viscosity of the lubricating oil at the low temperature engine start can be effectively suppressed, control response of the opening and closing timing of the intake valve by the phase-change mechanism 4 in the early stage of the engine start can be improved. It is therefore possible to improve the operating response of the phase-change mechanism 4 and obtain good engine startability.

Here, in a case where the camshaft 2 is controlled and previously fixed to a relative rotational phase at the engine stop, which is suitable for the low temperature engine start, e.g. the middle rotational phase by the phase-change mechanism 4, it is not necessarily required to previously energize the coil 18 (previously supply the current to the coil 18) by the engine start indication detecting circuit 57. However, if the control unit 56 is set so as to always previously supply the current to the coil 18, this contributes to some improvement in the operating response of the phase-change mechanism 4 after the engine start.

Further, as described above, since the speed reduction mechanism 8 is not subjected to the high viscous drag of the lubricating oil, as the electric motor 12, an electric motor whose output torque is small can be used. This allows size reduction and weight reduction of the variable valve apparatus as a whole.

The present invention is not limited to structure or configuration of the above embodiment. For instance, the energization duration time for which after the indication or the sign of the engine start is detected by the engine start indication detecting circuit 57, the current is supplied to the coil 18 could be set to a predetermined time by a timer.

Further, in the present embodiment, the energization amount (the current amount) of the coil 18 through the engine start indication detecting circuit 57 is set to an amount required for the heat generation of the coil 18. However, the current amount of the coil 18 could be reduced according to the engine coolant temperature or the engine oil temperature at the engine start, or the current amount of the coil 18 might be set to be the same as the current amount for the drive of the phase-change mechanism 4.

Although the present embodiment shows the case where the variable valve apparatus is provided at the intake valve side, the variable valve apparatus could be provided at an exhaust valve side of the internal combustion engine. In this case, at the engine stop, the relative rotational phase of the camshaft 2 is set to the most-advanced angle side by the phase-change mechanism 4.

Moreover, the engine temperature could be sensed not only by the engine coolant temperature sensor (an engine coolant temperature detecting unit) but also by the engine oil temperature sensor (an engine oil temperature detecting unit).

From the foregoing, the present invention includes the following structure or configuration of the variable valve apparatus, and has the following effects.

(a) In the controller of the variable valve apparatus of the internal combustion engine, when maintaining the current supply to the electric motor for the predetermined time from the time point of the detection of the indication of the engine start to the engine cranking start, the output member is in a no-operation state.

(b) In the controller of the variable valve apparatus of the internal combustion engine, the current supplied to the electric motor for the predetermined time from the time point of the detection of the indication of the engine start to the engine cranking start is a maximum current.

(c) In the variable valve system of the internal combustion engine, the current supply to the electric motor is maintained from the time point of the detection of the indication of the engine start to an engine cranking start.

(d) In the controller of the variable valve apparatus of the internal combustion engine, in a state in which the operation of the output member is restrained at a time point of the engine cranking start, the current supply to the electric motor is stopped.

(e) In the controller of the variable valve apparatus of the internal combustion engine, during the engine cranking, the electric motor is controlled so as to make the opening and closing timing of the engine valve suitable for the engine start.

(f) In the controller of the variable valve apparatus of the internal combustion engine, an amount of the current supply to the electric motor from the time point of the detection of the indication of the engine start to the engine cranking start is greater than an amount of a current supplied to the electric motor for operating the output member during the engine cranking.

(g) In the variable valve system of the internal combustion engine, in a case of an engine stop, after bringing the output member to a restraining state in which the operation of the output member is restrained, the engine is stopped.

(h) In the variable valve system of the internal combustion engine, an output shaft of the electric motor is inserted into the speed reduction mechanism, and the output shaft forms a part of the speed reduction mechanism.

(i) In the variable valve system of the internal combustion engine, a seal member that restricts entry of the lubricating oil, which lubricates the speed reduction mechanism, to an electric motor side is provided between the electric motor and the speed reduction mechanism, and an inner peripheral portion of the seal member is set so as to make sliding-contact with the output shaft of the electric motor.

(j) In the variable valve system of the internal combustion engine, the electric motor is a brush DC motor, and a coil is wound so as to rotate integrally with the output shaft of the electric motor.

(k) In the variable valve system of the internal combustion engine, the seal member is set close to the coil of the electric motor from an axial direction of the electric motor.

With this structure, a temperature of the seal member can be immediately increased.

(l) In the variable valve system of the internal combustion engine, a metal partition wall that partitions the electric motor and the speed reduction mechanism is provided between the electric motor and the speed reduction mechanism, and the metal partition wall is positioned close to the coil.

(m) In the variable valve system of the internal combustion engine, a portion of the metal partition wall, which is close to the coil, is formed thin as compared with the other portion of the metal partition wall.

(n) In the variable valve system of the internal combustion engine, the variable valve apparatus changes a valve timing (the opening and closing timing) of the engine valve by a rotating operation of the output member.

(o) In the variable valve system of the internal combustion engine, the temperature detecting unit is an engine coolant temperature sensor that detects an engine coolant temperature.

(p) In the variable valve system of the internal combustion engine, the temperature detecting unit is an engine oil temperature sensor that detects a lubricating oil temperature of the engine.

(q) In the variable valve system of the internal combustion engine, the engine start indication detecting unit judges the indication of the engine start by detecting a release of a lock of a door of a vehicle that is in a state in which the engine stops and the door is locked.

(r) In the variable valve system of the internal combustion engine, the output member is restrained to a most-advanced angle position of the operation range of the output member during a time from the time point when the indication of the engine start is detected by the engine start indication detecting unit to the time point when the normal control is started.

(s) In the variable valve system of the internal combustion engine, the output member is restrained to a most-retarded angle position of the operation range of the output member during a time from the time point when the indication of the engine start is detected by the engine start indication detecting unit to the time point when the normal control is started.

The entire contents of Japanese Patent Application No. 2013-194160 filed on Sep. 19, 2013 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A controller of a variable valve apparatus of an internal combustion engine, the variable valve apparatus having an output member that is operated according to a power transmitted from an electric motor through a speed reduction mechanism adjacent to the electric motor and changing opening and closing timing of an engine valve according to the operation of the output member, the speed reduction mechanism being supplied with lubricating oil, the controller comprising:

an engine start indication detecting circuit that detects an indication of an engine start before an ignition switch is ON, and wherein when the indication of the engine start is detected by the engine start indication detecting circuit in a state in which temperature of the engine is lower than a predetermined temperature, the electric motor is supplied with a current, and the current supply to the electric motor is maintained for a predetermined time from a time point of the detection of the indication of the engine start to an engine cranking start.

2. The controller of the variable valve apparatus of the internal combustion engine as claimed in claim 1, wherein:

when maintaining the current supply to the electric motor for the predetermined time from the time point of the detection of the indication of the engine start to the engine cranking start, the output member is in a no-operation state.

3. The controller of the variable valve apparatus of the internal combustion engine as claimed in claim 2, wherein:

in a state in which the operation of the output member is restrained at a time point of the engine cranking start, the current supply to the electric motor is stopped.

4. The controller of the variable valve apparatus of the internal combustion engine as claimed in claim 3, wherein:

during the engine cranking, the electric motor is controlled so as to make the opening and closing timing of the engine valve suitable for the engine start.

5. The controller of the variable valve apparatus of the internal combustion engine as claimed in claim 4, wherein:

an amount of the current supply to the electric motor from the time point of the detection of the indication of the engine start to the engine cranking start is greater than an amount of a current supplied to the electric motor for operating the output member during the engine cranking.

6. A controller of an electric motor used for a variable valve apparatus of an internal combustion engine, the variable valve apparatus having an output member that is operated according to a power transmitted from the electric motor through a speed reduction mechanism adjacent to the electric motor and changing opening and closing timing of an engine valve according to the operation of the output member, the speed reduction mechanism being supplied with lubricating oil, the controller comprising:

an engine start indication detecting circuit that detects an indication of an engine start before an ignition switch is ON, and wherein when the indication of the engine start is detected by the engine start indication detecting circuit in a state in which temperature of the engine is lower than a predetermined temperature, the electric motor is supplied with a current, and the current supply to the electric motor is maintained at least for a predetermined time from a time point of the detection of the indication of the engine start to an engine cranking start with the operation of the output member restrained.

7. A variable valve system of an internal combustion engine, comprising:

a variable valve apparatus having (a) an electric motor;

(b) a speed reduction mechanism disposed adjacent to the electric motor and supplied with lubricating oil; and (c) an output member operated according to a power transmitted from the electric motor through the speed reduction mechanism, and the variable valve apparatus changing opening and closing timing of an engine valve according to the operation of the output member;

a temperature detecting unit which detects an engine temperature;

an engine start indication detecting unit which detects an indication of an engine start; and a controller for controlling the electric motor, which when a temperature detected by the temperature detecting unit is lower than a predetermined temperature, supplies a current to the electric motor and maintains the current supply to the electric motor for a predetermined time from a time point when the indication of the engine start is detected by the engine start indication detecting unit to a time point when a normal control is started so that in a state in which the output member is restrained to one side of an operation range of the output member, the output member is operated in a restraining direction.

8. The variable valve system of the internal combustion engine as claimed in claim 7, wherein:

the current supply to the electric motor is maintained from the time point of the detection of the indication of the engine start to an engine cranking start.

9. The variable valve system of the internal combustion engine as claimed in claim 7, wherein:

in a case of an engine stop, after bringing the output member to a restraining state in which the operation of the output member is restrained, the engine is stopped.

10. The variable valve system of the internal combustion engine as claimed in claim 7, wherein:

an output shaft of the electric motor is inserted into the speed reduction mechanism, and the output shaft forms a part of the speed reduction mechanism.

11. The variable valve system of the internal combustion engine as claimed in claim 10, wherein:

a seal member that restricts entry of the lubricating oil, which lubricates the speed reduction mechanism, to an electric motor side is provided between the electric motor and the speed reduction mechanism, and an inner peripheral portion of the seal member is set so as to make sliding-contact with the output shaft of the electric motor.

12. The variable valve system of the internal combustion engine as claimed in claim 11, wherein:

the electric motor is a brush DC motor, and a coil is wound so as to rotate integrally with the output shaft of the electric motor.

13. The variable valve system of the internal combustion engine as claimed in claim 12, wherein:

the seal member is set close to the coil of the electric motor from an axial direction of the electric motor.

14. The variable valve system of the internal combustion engine as claimed in claim 12, wherein:

a metal partition wall that partitions the electric motor and the speed reduction mechanism is provided between the electric motor and the speed reduction mechanism, and the metal partition wall is positioned close to the coil.

15. The variable valve system of the internal combustion engine as claimed in claim 14, wherein:

a portion of the metal partition wall, which is close to the coil, is formed thin as compared with the other portion of the metal partition wall.

16. The variable valve system of the internal combustion engine as claimed in claim 7, wherein:

the temperature detecting unit is an engine coolant temperature sensor that detects an engine coolant temperature.

17. The variable valve system of the internal combustion engine as claimed in claim 7, wherein:

the temperature detecting unit is an engine oil temperature sensor that detects a lubricating oil temperature of the engine.

18. The variable valve system of the internal combustion engine as claimed in claim 7, wherein:

the engine start indication detecting unit judges the indication of the engine start by detecting a release of a lock of a door of a vehicle that is in a state in which the engine stops and the door is locked.

19. The variable valve system of the internal combustion engine as claimed in claim 7, wherein:

the output member is restrained to a most-advanced angle position of the operation range of the output member during a time from the time point when the indication of the engine start is detected by the engine start indication detecting unit to the time point when the normal control is started.

20. The variable valve system of the internal combustion engine as claimed in claim 7, wherein:

the output member is restrained to a most-retarded angle position of the operation range of the output member during a time from the time point when the indication of the engine start is detected by the engine start indication detecting unit to the time point when the normal control is started.

21. A controller of a variable valve apparatus of an internal combustion engine, the variable valve apparatus having an output member that is operated by supplying a current to a coil and changing opening and closing timing of an engine valve according to an operation of the output member, the controller comprising:

an engine start indication detecting circuit that detects an indication of an engine start before an ignition switch is ON, wherein when the indication of the engine start is detected by the engine start indication detecting circuit in a state in which temperature of the engine is lower than a predetermined temperature, the coil is supplied with the current, and the current supply to the coil is maintained for a predetermined time from a time point of the detection of the indication of the engine start before the ignition switch is ON to an engine cranking start.

* * * * *